United States Patent [19]

Long

[11] 4,203,620

[45] May 20, 1980

[54] AIR TRAVEL INSURANCE ASSEMBLAGE AND METHOD OF VALIDATING

[76] Inventor: Leonard L. Long, The Darlington, Suite 7, 2025 Peachtree Rd., NE., Atlanta, Ga. 30309

[21] Appl. No.: 940,943

[22] Filed: Sep. 11, 1978

[51] Int. Cl.[2] ..... B42D 15/00

[52] U.S. Cl. ..... 283/23; 229/92.8; 283/54

[58] Field of Search ..... 229/92.3, 92.7, 92.8; 282/25, 11.5 R; 283/23, 54

[56] References Cited

U.S. PATENT DOCUMENTS

| | | | |
|---|---|---|---|
| 618,662 | 1/1899 | Grout | 283/23 |
| 867,613 | 10/1907 | Scragg | 229/73 |
| 1,000,623 | 8/1911 | Penfield | 283/54 |
| 1,591,231 | 7/1926 | Otis | 282/25 |
| 2,835,512 | 5/1958 | Whitman | 282/25 |

*Primary Examiner*—John McQuade

*Attorney, Agent, or Firm*—Newton, Hopkins & Ormsby

[57] ABSTRACT

To reduce the cost of air travel insurance premiums substantially, by eliminating the need for insurance company representatives, agents, or machines, in airport terminals or elsewhere, purchasers contract with and prepay a nominal sum to the insurance company for a selected amount of air travel insurance coverage. The insureds are supplied through the mail with a designated number of proper documents in assembled relationship for use in coaction with conventional air travel tickets in a manner whereby the purchaser can assure the validation of his or her air travel insurance prior to take-off on a mode of air travel. A return envelope is provided, addressed to the insurance company or agent. The envelope includes a positioning means for the air travel ticket and insurance documents assembly to be temporarily assembled with the envelope to enable the purchaser to imprint the validating indicia on an element of the ticket to be given to the air travel ticket agent and also on the insurance documents assembly. The documents are delivered to the insurance company or agent, the beneficiary, and to a third party disinterested institutional trust.

16 Claims, 5 Drawing Figures

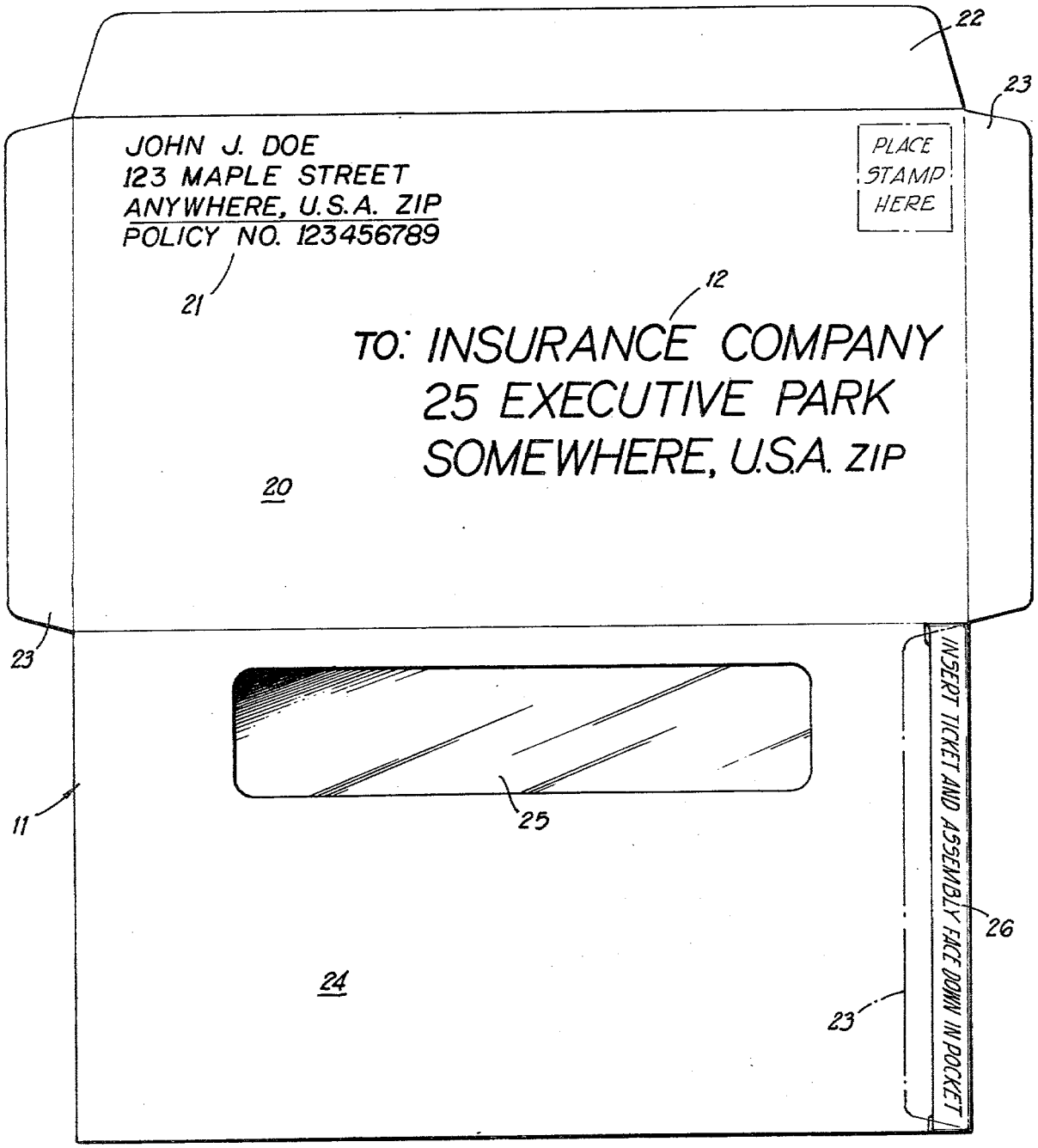
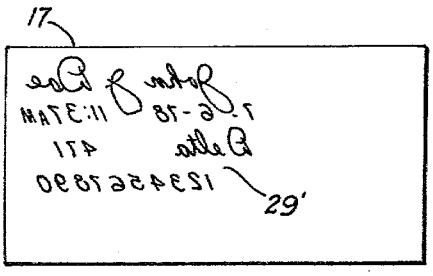
FIG 2
FIG 4A

AIR TRAVEL INSURANCE ASSEMBLAGE AND METHOD OF VALIDATING

BACKGROUND OF THE INVENTION

Many air travel passengers resist acquiring air travel insurance due to the relatively high cost thereof, and because of the necessity for standing in still another line at an airport terminal and engaging in time-consuming negotiations and doing further work at a very inconvenient time. The present invention has for its objective to deal completely with the above problem in such a way that air travel passengers will be much more likely to acquire air travel insurance before each and every flight. The inconvenient delay and effort at the time of departure is totally eliminated by the invention. Furthermore, the invention accomplishes a substantial reduction in the cost of air travel insurance premiums which is passed on to the insurance purchaser. This cost reduction is realized by entirely eliminating the need for any airport terminal concessionaire selling air travel insurance, or for insurance company representatives, agents, or machines at airport terminals or elsewhere. The resulting benefits to purchasers of air travel insurance, to the insurance companies, to the carriers, and the public which can be realized by adoption of the invention on a national and/or international scale are truly tremendous.

Other objects and advantages of the invention will become apparent during the course of the following description.

In order to comply with the duty to disclose known prior art under 37 C.F.R. 1.56, the following U.S. patents are made of record herein: Nos. 867,613, 1,000,623, 1,141,172, 1,254,870, 1,591,231, 1,714,824, 2,723,078, 3,187,986, 3,329,333, 3,790,070.

SUMMARY OF THE INVENTION

Briefly summarized, an air travel passenger and potential air travel insurance purchaser can be circularized through the mail, newspapers, magazines and various media, or by an insurance or travel agent directly. The purchaser can then contract for a desired amount of coverage from the insurance company designating a beneficiary and a third party disinterested institutional trust. The insurance company or agent will then supply the purchaser with a designated number of insurance documents assemblies in a highly convenient form. These assemblies will also include a return envelope which will contain areas upon which to imprint air travel data and will also be used for mailing the next succeeding premium or an authorization to charge the next premium to the purchaser. The purchaser, after obtaining an air travel ticket, interleaves the ticket with the documents assembly and then places the composite assembly in a positioning pocket of the return envelope.

The pertinent air travel data is imprinted by the insurance purchaser in the area provided on the return envelope. The identical data is simultaneously imprinted by an included duplicating means of the insurance documents assembly on a portion of the back of the air travel ticket, and by a second included duplicating means of the insurance documents assembly on certain of the insurance documents which are mailed to the insurance company or agent, the institutional trust, and the designated beneficiary. The air travel insurance is considered validated upon delivery of the air travel ticket to and acceptance by the air travel ticket agent. The foregoing completely effectuates validation of the air travel insurance contract, since the consideration has been previously paid or charged, and other contractual data, such as the amount of insurance, beneficiary, address, etc. has been established and agreed upon.

The inventive concept and documentation embodied therein provides a rapid, convenient and very efficient method of obtaining air travel insurance and effecting the validation of the contract of insurance. The air travel ticket is simply withdrawn from the return envelope for normal usage by the purchaser and the insurance documents are individually sent to the insurance company or agent, institutional trust, and beneficiary. Minor variations in the format of documents, preprinting and providing for postage are also contemplated.

BRIEF DESCRIPTION OF THE DRAWINGS

FIG. 2 is a plan view of a return envelope prior to folding for usage and showing the outer side thereof.

FIG. 4*a* is a plan view, on a reduced scale, of that copy of the air travel ticket which is given to the air travel ticket agent with the insurance validating indicia thereon when the insurance is to be validated.

DETAILED DESCRIPTION

Figure 1:
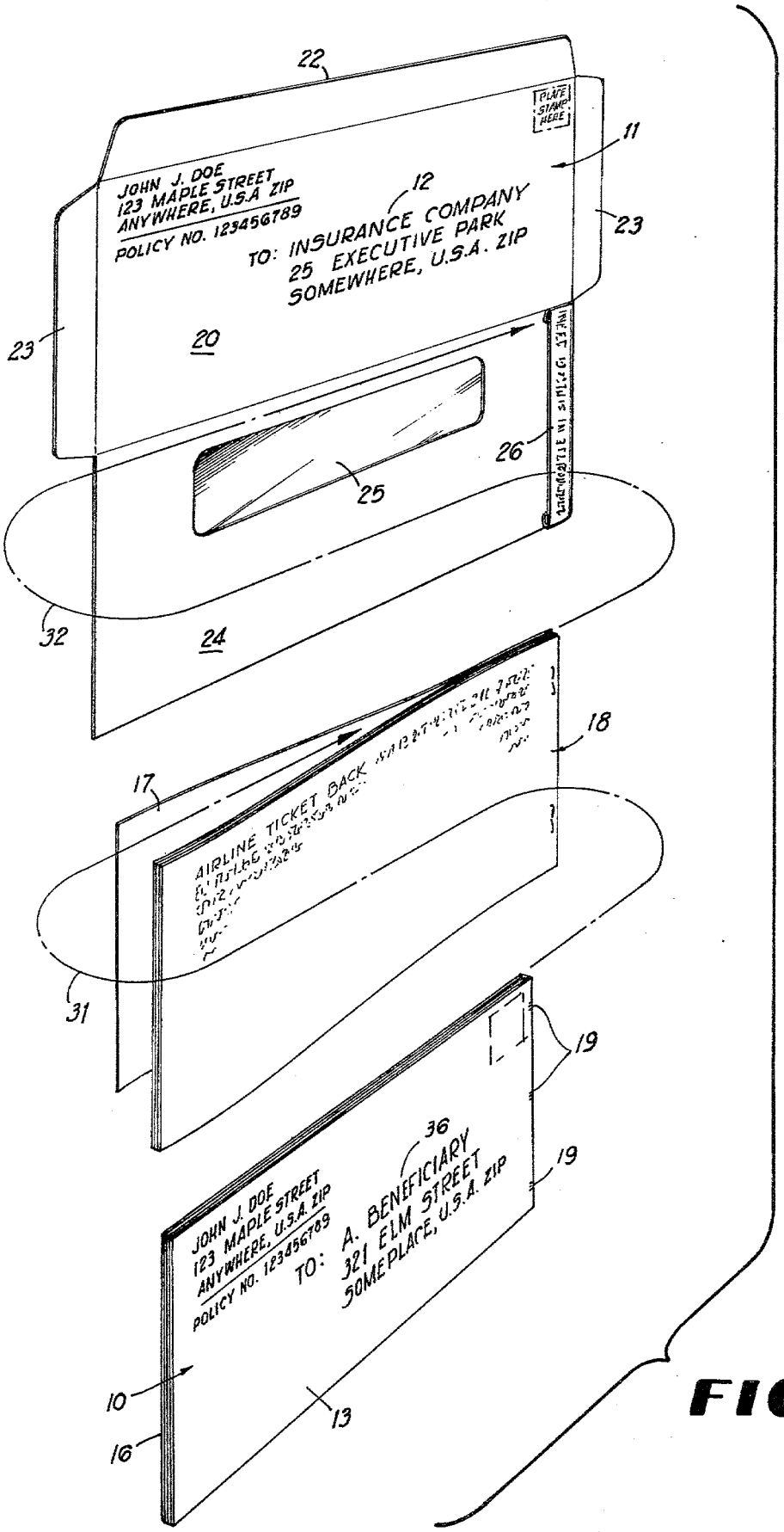
FIG. 1 is an exploded perspective view of the insurance documents assembly components embodied in the invention.

Referring to the drawings in detail wherein like numerals designate like parts, the numeral 10 designates a documents assembly or package for air travel insurance supplied by mailing or otherwise to potential purchasers by insurance companies or agents. The documents assembly or package 10 is accompanied by a return envelope 11 preferably pre-addressed to the insurance company or agent, as illustrated at 12 in FIGS. 1 and 2. One or more of the elements 10 and 11 may be sent to each potential insurance purchaser according to the wishes of the insurance company or agent.

Figure 4:
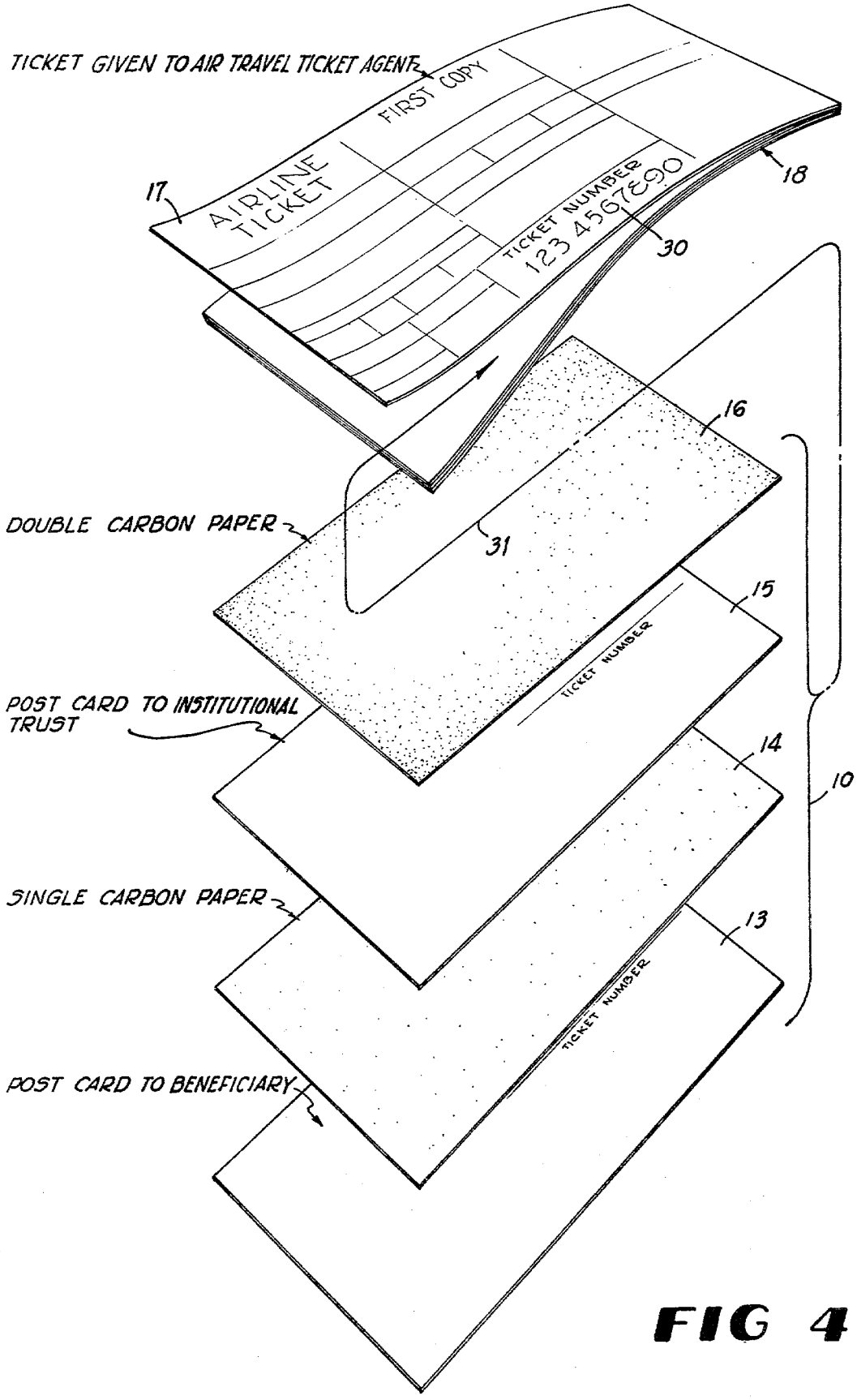
FIG. 4 is an exploded perspective view of an insurance documents assembly or package and a co-acting air travel ticket.

The insurance documents package 10, FIG. 4, includes a postal card 13 ultimately to be sent to the beneficiary under the insurance policy, a registering duplicating sheet or carbon paper sheet 14 containing a duplicating material only on its lower side facing the postal card 13, another postal card 15 ultimately to be sent to a third party institutional trust and a double duplicating sheet or carbon paper sheet 16 to imprint simultaneously on the card 15 and on the back of a first copy 17 of a conventional airline ticket 18 purchased and used by the passenger or insured in the usual manner. The insurance documents package or assembly 10 has its several equally-sized rectangular sheets 13, 14, 15 and 16 clinched in assembled relationship, preferably at one end as indicated at 19 by the use of conventional means as shown in the lower portion of FIG. 1.

The return envelope 11, which is a key element of the invention, is provided to the insurance purchaser in flat unfolded form. On its outer surface, a main body portion panel 20, FIG. 2, is pre-addressed to the insurance company or agent, as previously described. The insurance purchaser's name, return address and the insurance policy number is preprinted on the envelope as at 21.

Figure 3:
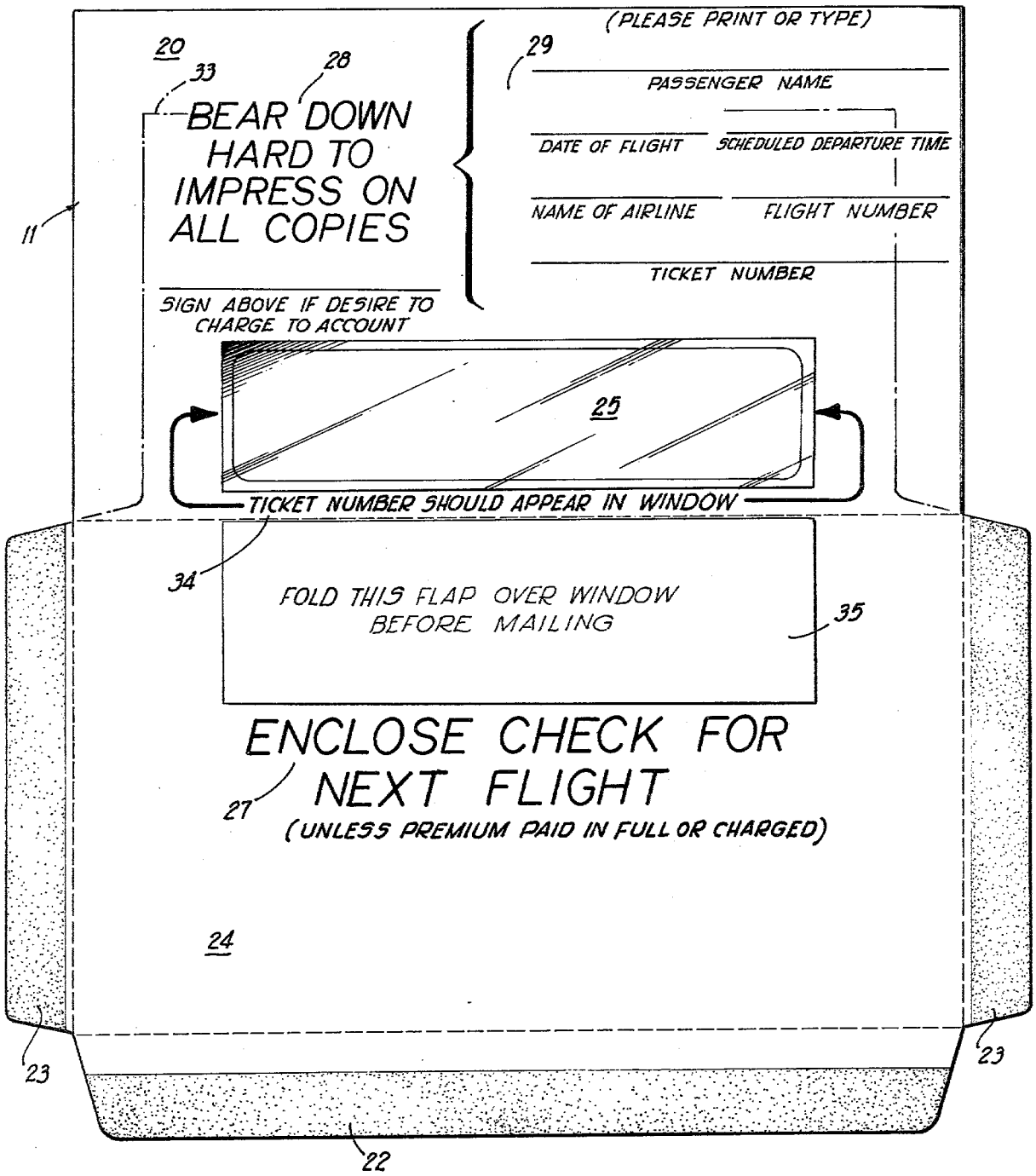
FIG. 3 is a plan view showing the interior side of the return envelope in a reverse position from FIG. 2.

The panel 20 also has three marginal foldable flaps 22 and 23 which are gummed on the reverse side as illustrated in FIG. 3. The other main panel 24 of the foldable return envelope has a transparent window 25 provided therein, for a purpose to be described. Also at one end of the panel 24 on the exterior of the envelope, a narrow temporary positioning means or pocket 26 for the preassembled documents package 10 and air travel ticket 18 is provided so that the latter may have their corresponding end portions held securely while insurance policy validating indicia is being written by the insurance purchaser on the opposite side of the panel 24, FIG. 3.

Referring to the opposite side of the envelope, its interior side, FIG. 3, payment instructions 27 may be imprinted on the panel 24 and suitable writing instructions 28 similarly imprinted on the panel 20, together with a printed block 29 on which the insurance purchaser writes his name, data of flight, departure time, mode of air travel, flight number, and air travel ticket number as shown at 30 on the first copy 17 of the ticket 18.

Prior to writing in the block or area 29, and referring to FIGS. 1 and 4, the insurance purchaser inserts the assembled documents package 10 with the ticket 18 by placing the package 10 between the first copy 17 and the remaining sheets of the ticket as indicated by the arrow 31. This temporary assemblage of air travel ticket and insurance documents is inserted in the pocket 26 of the envelope as shown by the arrow 32 in FIG. 1. It will be appreciated that the double duplicating sheet or carbon paper sheet 16 is now between the underside of first ticket copy 17 and the card 15 of the documents assembly 10. This assemblage now held by the pocket 26 lies beneath the panel 20 as shown at 33 in FIG. 3. At this time, the insurance purchaser firmly writes the described validating data or indicia in the block or area 29. Such indicia or data will simultaneously be recorded on the envelope area 29, on the underside of the ticket copy 17 in reversed or mirror image fashion as at 29' in FIG. 4*a*, on the postal card 15 beneath the duplicating sheet or carbon sheet 16 and on the postal card 13 beneath the carbon sheet 14.

During such writing, the purchaser will know that the insurance documents assembly and ticket, which is added to the assembly, are properly placed in the pocket 26 because, if so placed, the ticket number 30 will be visible through the window 25 in accordance with further printed instructions 34 on the envelope, FIG. 3, for the convenience of the user.

When the validating indicia has been written in the described manner, the air travel ticket and package 10 are separated from the pocket 26 and the ticket 18 is separated from the documents assembly 10 for use in the customary manner. A foldable opaque flap 35 provided on the interior of the envelope near the window 25 is now folded over the window prior to mailing so that neither the check nor charge authorization for the due premium, nor anything else, will show through the window. This feature is to avoid confusing the postal authorities. The beneficiary card and institutional trust card are separated from the insurance documents assembly. After folding the envelope, the envelope is closed and sealed by means of its flaps 22 and 23 and then mailed to the insurance company or agent. In FIG. 2, it may be noted as shown in phantom lines on the panel 24 that the sealing flap 23 is wide enough to completely cover and seal the pocket 26 which lies on the outside of the envelope during transit through the mail and this feature is to avoid having the pocket become snagged or hung up on a foreign object or with another envelope.

When the passenger is departing on his or her flight, he will surrender to the air travel ticket agent the copy 17 of the ticket with the validating indicia on the back of the copy 17 as shown at 29', FIG. 4*a*. The insurance company or agent, upon receiving the envelope 11, will have its or his own copy of the validating indicia by keeping the envelope or envelope panel 20. The passenger will also mail separately the cards 15 and 13 also containing the same insurance validating indicia to the institutional trust and the designated beneficiary. The beneficiary card and institutional trust card are preaddressed by the insurance company or agent supplying the insurance documents assemblies to its insurance purchasers. Thus, all involved parties in the event of a mode of travel crash will possess documents showing the insurance indicia or data pertinent to a particular passenger and a particular mode of air travel ticket number, thus avoiding all confusion and mistakes of identification or collusion. The work or effort required of the insurance purchaser is less than that required when obtaining flight insurance at an airport terminal and the process is much more convenient and casual since it can be done at home, in the office or elsewhere in the absence of pressure at the time of departure. Additionally, the cost of the air travel insurance premium is markedly reduced as previously explained due to the fact that the insurance company personnel and concessionaire charges at the airport terminal are no longer required.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. For use with a conventional air travel ticket as a means to facilitate the validation of air travel insurance, an air travel insurance documents assembly, said insurance documents assembly including an institutional trust mailing element, a beneficiary mailing element, a double-active face duplicating sheet at one side of said institutional trust mailing element and a single-active face duplicating sheet between the institutional trust mailing element and the beneficiary mailing element, and a return envelope having a positioning means on one panel thereof for said insurance documents assembly and an air travel ticket, the opposite side of such panel having an area to receive written air travel indicia, said air travel insurance documents assembly being adapted to be temporarily interleaved with an air travel ticket by placing the assembly beneath the first copy of the ticket, the documents assembly and ticket then being engaged as a unit with said positioning means of the return envelope to be held thereby while the insurance purchaser writes said air travel indicia in said area, said assembly and ticket then being separated from the positioning means and from each other, and the insurance documents assembly having its elements separated, whereby the institutional trust mailing element and beneficiary mailing element can be separately mailed and the return envelope can be mailed with payment to an insurance company or agent, validation of the air travel insurance being completed when said first copy of the air travel ticket with said air travel indicia thereon is delivered to and accepted by a ticket agent.

2. The invention as defined in claim 1, and said area being preprinted to facilitate the writing of said air travel indicia by a purchaser, said panel also having preprinted credit account indicia thereon for use by an insurance purchaser.

3. The invention as defined in claim 1, and said return envelope being an initially unfolded preprinted envelope including said one panel, and a second panel bearing the address of an insurance company or agent and having gummed closure flaps, and a transparent window in said one panel through which the insurance purchaser can see the number of the air travel ticket while writing the air travel indicia in said area.

4. The invention as defined in claim 1, and said double-active face duplicating sheet having one of its faces in opposing relationship to the back of the institutional trust mailing element, and said single-active face duplicating sheet having its active face in opposing relationship to the back of the beneficiary mailing element.

5. The invention as defined in claim 3, and an opaque flap attached to said envelope near said transparent window and being foldable over said window to cover the window when the envelope is moving through the mails.

6. The invention as defined in claim 1, and said positioning means comprising a pocket on said one panel of the envelope and on the side of said one panel remote from said area to receive written air travel indicia.

7. The invention as claimed in claim 6 wherein said return envelope also comprises a second panel adapted to be folded into juxtaposition to said one panel, and a gummed flap carried by said second panel and adapted to be folded over said pocket and seal the pocket closed during passage through the mails to avoid snagging of the pocket on another envelope or object.

8. For use with a conventional air travel ticket as a means to facilitate the validation of air travel insurance, a preassembled air travel insurance multiple elements documents assembly, adapted to be interleaved with an air travel ticket, said assembly comprising a plurality of sheets adapted to receive written matter and a plurality of duplicating sheets interleaved with said first-mentioned sheets and adapted to transmit written matter thereto, and an envelope for returning to an insurance company or agent and including a positioning means for said documents assembly and ticket on one side of one panel thereof and having an area for pertinent air travel insurance indicia on the opposite side of said panel.

9. The invention as defined in claim 8, and said envelope comprising an initially flat unfolded envelope blank having gummed closure flaps and a return address on a second panel thereof.

10. For use with a conventional air travel ticket to facilitate validation of air travel insurance, a plurality of mailing elements, one of said mailing elements having an air travel insurance indicia area for the entry of validation supportive evidence by an air travel insurance purchaser, and said plurality of mailing elements being adapted to be temporarily assembled with said air travel ticket so that a copy of the ticket which is delivered to an air travel ticket agent on departure is positioned between two of the mailing elements while the air travel insurance purchaser writes said supportive evidence in said area, and duplicating means for imprinting the written air travel insurance indicia constituting said supportive evidence onto other mailing elements and onto said copy of the ticket to be delivered to said air travel ticket agent to complete the validation of the air travel insurance.

11. The invention as defined in claim 10, wherein one of said mailing elements having said supportive evidence thereon is addressed to an insurance company or agent for mailing prior to boarding.

12. The invention as defined in claim 10, wherein one of said mailing elements having said supportive evidence thereon is addressed to a designated beneficiary for mailing prior to boarding.

13. The invention as defined in claim 10, wherein one of said mailing elements having said supportive evidence thereon is addressed to an institutional trust for mailing prior to boarding.

14. The method of completing insurance documents while simultaneously marking an air travel ticket for validation of the documents in advance of travel without the inconvenience of dealing with an insurance agent at an air terminal during departure, said method comprising the steps of temporarily assembling with an air travel ticket a plurality of mailing elements and means for duplicating written data, positioning the air travel ticket between two of said mailing elements, writing air travel indicia on one of said mailing elements which indicia is in turn imprinted by said duplicating means on other mailing elements and on the back of said copy of the ticket to be given to said ticket agent, separating the ticket from the mailing elements, delivering to an air travel ticket agent the air travel ticket having said air travel indicia and data on the back thereof thereby validating the insurance coverage for the flight taken, and mailing one of said mailing elements having air travel indicia and identifying data on the back thereof to the insurance company or agent.

15. A method as defined in claim 14, and the additional step of mailing a further one of said mailing elements having air travel indicia and identifying data on the back thereof to the institutional trust.

16. A method as defined in claim 15, and the additional step of mailing a still further one of said mailing elements having air travel indicia and identifying data on the back thereof to the beneficiary.

* * * * *